US009314667B2

(12) United States Patent
Puerschel

(10) Patent No.: US 9,314,667 B2
(45) Date of Patent: Apr. 19, 2016

(54) STATIONARY TRAINING BICYCLE

(71) Applicant: Andreas Fischer, Nuremburg (DE)

(72) Inventor: Bernd Puerschel, Nuremberg (DE)

(73) Assignee: ANDREAS FISCHER, Nürnberg (DE)

( * ) Notice: Subject to any disclaimer, the term of this patent is extended or adjusted under 35 U.S.C. 154(b) by 98 days.

(21) Appl. No.: 14/044,333

(22) Filed: Oct. 2, 2013

(65) Prior Publication Data

US 2014/0106936 A1 Apr. 17, 2014

(30) Foreign Application Priority Data

Oct. 2, 2012 (DE) ..... 10 2012 019 338

(51) Int. Cl.

| | |
|---|---|
| ***A63B 24/00*** | (2006.01) |
| ***A63B 21/005*** | (2006.01) |
| ***A63B 22/06*** | (2006.01) |
| ***A63B 21/22*** | (2006.01) |

(52) U.S. Cl.

CPC ..... *A63B 24/0087* (2013.01); *A63B 21/0051* (2013.01); *A63B 21/225* (2013.01); *A63B 22/0605* (2013.01); *A63B 24/0062* (2013.01); *A63B 2220/34* (2013.01); *A63B 2220/62* (2013.01); *A63B 2225/02* (2013.01); *A63B 2225/30* (2013.01)

(58) Field of Classification Search

CPC ..... A63B 21/005; A63B 21/0056; A63B 21/0051; A63B 21/0057; A63B 22/06; A63B 22/0605; A63B 24/0087; A63B 24/0062; A63B 2220/62; A63B 2220/34; A63B 2225/02; A63B 2225/30

See application file for complete search history.

(56) References Cited

U.S. PATENT DOCUMENTS

| | | | | |
|---|---|---|---|---|
| 4,337,050 | A * | 6/1982 | Engalitcheff, Jr. | 434/260 |
| 4,976,424 | A * | 12/1990 | Sargeant et al. | 482/6 |
| 5,083,772 | A * | 1/1992 | Brown | 482/59 |
| 5,318,487 | A * | 6/1994 | Golen et al. | 482/5 |
| 7,311,640 | B2 * | 12/2007 | Baatz | 482/4 |

(Continued)

FOREIGN PATENT DOCUMENTS

| | | | |
|---|---|---|---|
| DE | 36 17 072 | A1 | 11/1987 |
| DE | 4137526 | A1 | 5/1993 |

(Continued)

OTHER PUBLICATIONS

Machine translation of DE4137526.*

(Continued)

*Primary Examiner* — Loan H Thanh
*Assistant Examiner* — Sundhara Ganesan
(74) *Attorney, Agent, or Firm* — Lucas & Mercanti, LLP

(57) ABSTRACT

Stationary training bicycle having a pedal crank mechanism coupled to a transmission by a flywheel. A magnetic braking device interacts with the flywheel and is variable in its braking action. A calibration table stored in a computing device contains a plurality of braking device settings with reference rundown times of the flywheel not loaded via the pedal crank mechanism and relating to the speed reduction from a first speed to a second speed. The actual rundown time of the flywheel is ascertained at least once by means of a measuring device or the computing device and compared to the reference rundown times. If actual setting and target setting do not correspond, information relating to the actual setting can be output on the display device.

15 Claims, 2 Drawing Sheets

(56) References Cited

U.S. PATENT DOCUMENTS

Figure 1:
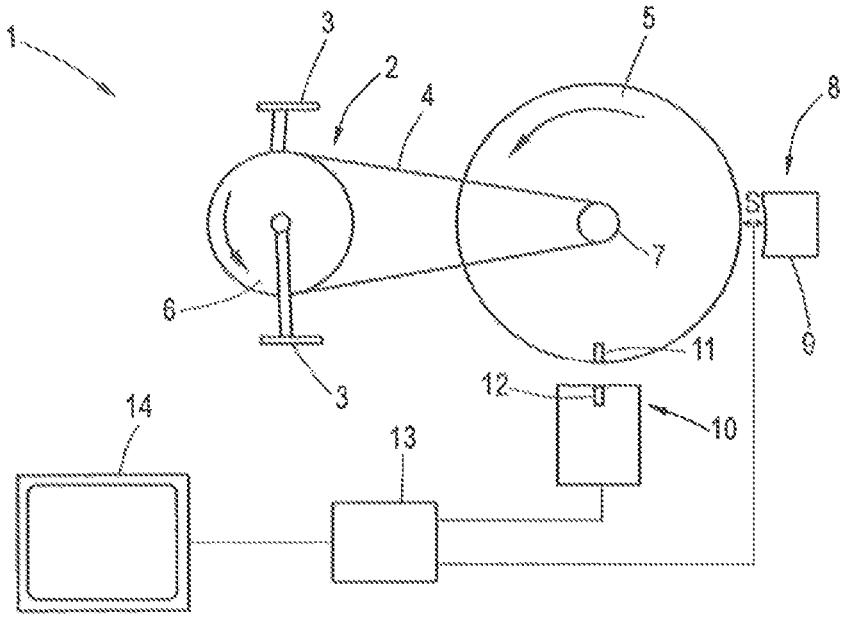

| | | | | |
|---|---|---|---|---|
| 2003/0181293 | A1* | 9/2003 | Baatz | 482/63 |
| 2005/0014611 | A1* | 1/2005 | Gearon | 482/73 |
| 2006/0234840 | A1* | 10/2006 | Watson et al. | 482/61 |
| 2007/0117680 | A1* | 5/2007 | Neff et al. | 482/8 |
| 2008/0096725 | A1* | 4/2008 | Keiser | 482/8 |
| 2011/0009239 | A1* | 1/2011 | Whelan, Jr. | 482/5 |

FOREIGN PATENT DOCUMENTS

| | | | |
|---|---|---|---|
| DE | 94 12 110 | U1 | 10/1994 |
| WO | 03/068327 | A2 | 8/2003 |

OTHER PUBLICATIONS

European Search Report for parallel application EP 13181002.0.
German Office Action for parallel application DE 10 2012 019 338.6.

* cited by examiner

| $S_{Brake}$ [%] | Reference run-down time [s] | Power values [W] with respect to speed (pedal crank) [RPM] | | | | | | | | | | |
|---|---|---|---|---|---|---|---|---|---|---|---|---|
| | | 30 | 40 | 50 | 60 | 70 | 80 | 90 | 100 | 110 | 120 | 130 |
| 10 | 19.54 | 14 | 16 | 19 | 23 | 28 | 35 | 43 | 52 | 61 | 70 | 80 |
| 20 | 18.33 | 20 | 24 | 27 | 31 | 36 | 43 | 51 | 60 | 69 | 78 | 88 |
| 30 | 17.44 | 31 | 39 | 41 | 55 | 62 | 70 | 79 | 84 | 90 | 97 | 105 |
| 40 | 16.23 | 37 | 49 | 61 | 70 | 81 | 93 | 101 | 112 | 120 | 127 | 135 |
| 50 | 15.03 | 42 | 54 | 67 | 79 | 86 | 95 | 105 | • • | • • | • • | 175 |
| 60 | 13.12 | 49 | • • | • • | • • | • • | • • | • • | • • | • • | • • | 233 |
| 70 | 11.07 | 57 | • • | • • | • • | • • | • • | • • | • • | • • | • • | 302 |
| 80 | 9.86 | 65 | • • | • • | • • | • • | • • | • • | • • | • • | • • | 378 |
| 90 | 7.73 | 72 | • • | • • | • • | • • | • • | • • | • • | • • | • • | 486 |
| 100 | 6.11 | 80 | • • | • • | • • | • • | • • | • • | • • | • • | • • | 601 |

STATIONARY TRAINING BICYCLE

CROSS-REFERENCE TO RELATED APPLICATIONS

This application claims the priority of DE 10 2012 019 338.6 filed Oct. 2, 2012, which is incorporated by reference herein.

The invention relates to a stationary training bicycle, comprising a pedal crank mechanism, which is coupled via a transmission to a flywheel, a magnetic braking device, which interacts with the flywheel and is variable in its braking action, and a computing device having assigned display device.

Such stationary training bicycles, also called indoor bicycles, enjoy great popularity both in the field of fitness studios and also in the private realm. The training person has the possibility of actively riding a bicycle, wherein the possibility is provided to him via an adjustable magnetic braking device of individually setting the load. This magnetic braking device interacts in known training bicycles with a flywheel, which is moved via the pedal crank mechanism actuated by the training person and a transmission. The transmission ratio of pedal crank mechanism to flywheel can be 1:10, for example. Depending on how large the set braking resistance is, i.e., how the braking device is set in its braking action by the training person, the power to be applied by the training person results, which is to be produced in order to move the flywheel or to achieve a specific flywheel speed or a corresponding pedal crank speed, respectively. Information about the instantaneous power to be produced can be then given to the training person via a computing device having associated display device, typically a sufficiently large display screen, i.e., a power display is output in watts on the display device. On the one hand, the set braking resistance, which is decisive for the level of the resistance opposing the flywheel rotation, which is to be overcome by the training person, is incorporated in the calculation of this power display, and also the speed of the pedal crank mechanism, for example.

Sometimes, however, the actual braking resistance, i.e., the resistance which opposes the flywheel movement and which the training person must finally overcome by power introduction, is different than that which is displayed via the corresponding braking device setting. This is because an array of design-related influencing factors are incorporated in the real braking resistance, which influence it. For example, the power loss of the drive by a belt tension, which varies over time, is to be mentioned here. In known bicycles, the pedal crank mechanism is typically coupled via a belt or a chain with the flywheel. This belt or the chain is subject to a certain change or wear, respectively, in the course of time, belt or chain lengthening can occur, however slight, and also the force coupling between belt and pedal coupling mechanism, on the one hand, or flywheel, on the other hand, can respectively vary because of a belt material change, for example. Furthermore, friction resistances within the participating plain bearings or roller bearings are to be mentioned, which have influence in the power loss of the drive, which in turn results in a change of the effective braking action. Furthermore, the material composition and quality of the flywheel material used, typically aluminum, are to be mentioned as mechanical influencing factors. Also, any possible tolerances in the spacing of the braking magnet or magnets of the braking device, which braking magnets are moved radially relative to the flywheel for variation of the braking action, have an influence on the effective braking action, as do any possible tolerances of the magnetic field strength of the braking magnet or magnets themselves.

The problem results therefrom that the real braking resistance, which is displayed on the display device and is perceived by the training person, varies over a large number of mass-produced training bicycles at an arbitrary speed and braking setting, consequently the displayed setting of the braking device therefore does not correspond with the real braking resistance. Since this braking setting is incorporated in the ascertainment of the power display, however, it results therefrom that the provided power display can therefore also be subject to errors. This power display can only vary within specific tolerances according to normative guidelines, however. If these guidelines are not maintained, complex repairs are required on the drive and braking system. I.e., as a result, braking resistances ascertained in the laboratory with respect to defined braking settings at specific crank speeds are not readily reproducibly provided on the mass-produced training bicycles.

The invention is therefore based on the problem of specifying a stationary training bicycle, which is improved in relation thereto and offers a possibility for a correct consideration of the real braking resistance within the power display ascertainment.

To solve this problem, it is provided according to the invention in a stationary training bicycle of the type mentioned at the beginning that a calibration table is stored in the computing device, containing a plurality of defined braking device settings, to which reference rundown times of the flywheel, which is not loaded via the pedal crank mechanism, relating to the speed reduction from a first speed to a second speed are assigned, wherein for the calibration the actual rundown time of the flywheel at a given target setting of the braking device is ascertained at least once by means of a measuring device or the computing device and, on the basis of the measured actual rundown time, by comparison to the reference rundown times, the actual setting of the braking device specific for the rundown time is determined and, if actual setting and target setting do not correspond, information relating to the actual setting can be output on the display device.

The invention is based on the fundamental finding that all design-related mechanical influencing factors or influencing factors on the drive and braking system side, respectively, are finally reflected in the rotational behavior of the flywheel. This finding is then utilized to provide a calibration possibility, to detect any possible non-correspondence of a target setting of the braking device, which is set by the user, to a factual actual setting of the braking device, i.e., to detect a disagreement of the real braking resistance with the set target braking resistance, and to be able to compensate for it accordingly or take it into consideration in the scope of the power ascertainment, respectively.

For this purpose, a calibration table is stored in the training bicycle according to the invention. Reference rundown times of the flywheel are stored in this table for a plurality of defined braking device settings. A reference rundown time is understood as the time which the flywheel, which was previously driven via the pedal crank mechanism but is no longer actively driven at the beginning of the time measurement, requires until its speed has decreased from a first speed to a second speed. These reference rundown times are ascertained on a reference training bicycle, which is used as a calibration reference for all subsequently mass-produced training bicycles, for the plurality of defined braking device settings. These reference rundown times are finally the result of the given reference input variables on the reference training bicycle, i.e., the circumstances quasi-provided as reference influencing factors within the drive and braking system of the reference training bicycle. Every ascertained reference rundown time is thus dependent, on the one hand, on these incorporated influencing factors, but, on the other hand, also on the concrete assigned braking device setting, of course.

These reference rundown times are now used within the calibration table as comparison times for corresponding actual rundown times of the mass-produced training bicycle. For this purpose, it is necessary for the training person to drive the flywheel via the pedal crank mechanism for the calibration. After ending the drive, via a corresponding measuring device (comprising a suitable computer or processor) or the computing device itself, which is then coupled to a measuring device which fundamentally detects the wheel rotation, the actual rundown time of the flywheel is measured or ascertained, i.e., the rundown time which the flywheel of the training bicycle actually requires for its speed to decrease in turn at a given target setting of the braking device from the first speed to the second speed, with respect to which the reference rundown times were also ascertained.

The computing device is now capable of ascertaining, solely via a comparison of the actual rundown time to the provided reference rundown times, to what extent the given target setting of the braking device on the mass-produced training bicycle is correct, consequently a correct braking resistance is thus set or displayed, respectively, via this, as was also provided on the reference training bicycle with respect to the ascertained actual rundown time. Therefore, if the actual rundown time corresponds to a reference rundown time, which was provided for the same reference setting of the braking device, as is also provided as a target setting on the mass-produced bicycle, within a specific tolerance interval, finally no differences are thus provided between the mass-produced training bicycle and the reference training bicycle, i.e., the display of the braking setting and therefore also the power ascertainment on the mass-produced training bicycle is correct and corresponds to that on the reference training bicycle.

However, if the computing device determines that the actual rundown time with respect to the target setting of the braking device does not correspond to the reference rundown time with respect to the reference braking device setting, the computing device thus checks with which other reference rundown time the actual rundown time corresponds or which it approximately comes closest to, respectively. If the actual rundown time is longer than the reference rundown time with respect to the same braking device setting, it results therefrom that the real braking resistance is lower than displayed for it by the target setting of the braking device. The computing device now displays a somewhat lower braking device setting as the real actual setting of the braking resistance, which thus reflects the real braking setting. In the inverse case, if the actual rundown time is shorter than the reference rundown time, the real braking resistance and therefore the real actual setting of the braking device is thus greater than the target setting set by the user, which is also displayed via the display device.

I.e., it can finally be ascertained solely via a comparison of the actual rundown time to the reference rundown time to what extent the braking behavior of the mass-produced training bicycle corresponds to that of the reference training bicycle, or in which direction a difference is provided and in which direction an adaptation must be performed. This adaptation then has the result that a correct power ascertainment corresponding to the real behavior is possible. This is because if the real actual braking resistance or the real braking behavior, respectively, is known and is tracked via the correction toward the actual setting, the ascertainment of the power values can also be based on the real braking resistance or the real actual setting, respectively.

These power values can be accommodated within the calibration table or assigned thereto, respectively, for example, and indeed in such a manner that corresponding concrete power values are again stored for defined braking device settings, which the applicant can thus fundamentally choose, and for defined speed values, for example, in the form of speeds of the pedal crank mechanism. Thus, if the defined braking device settings are plotted in tabular form along the coordinate, for example, in the form of defined steps or percentage specifications with respect to the braking action, and speed values of the pedal crank (pedals) are plotted along the abscissa, for example, increasing in the form of 5-RPM or 10-RPM steps, an extensive matrix thus results, which can be filled with concrete power values, which are in turn ascertained on the reference training bicycle. I.e., for every settable braking resistance or every settable braking device setting, respectively, and a corresponding actual speed, a concrete power value is ascertained, which the training person must apply at the given braking resistance and the given speed to drive the flywheel. For integration over time, even if the speed varies, the corresponding power value can now always be ascertained and integrated, to arrive at an overall power display. As a result, in the calibration table, power values, which the training person must apply at a given braking device setting and a given speed, to drive the flywheel, are accommodated in the calibration table for defined speed values and defined braking device settings, or assigned to the calibration table, wherein the computing device is implemented for the automatic ascertainment of the power as a function of the provided braking device setting and speed on the basis of the stored power values.

I.e., as a result of the calibration possibility according to the invention, on the one hand, it is ensured that the real braking resistance is always detected and, resulting therefrom, the provided real actual setting of the braking device is also detected and displayed, on the other hand, but also in the scope of the power ascertainment occurring later in training operation, the corresponding power values, which are assigned to this real braking resistance or the then correct braking resistance after the calibration, are taken into consideration, and therefore a correct power detection is also possible resulting from the calibration.

As described, the training person has the possibility of adjusting the braking device in a defined manner, therefore thus intentionally changing the braking resistance. This can either be performed in that the braking action is variable in defined steps, preferably in at least 10 steps, between a maximum braking action and no braking action. Proceeding from a setting without any braking action, 10 steps 1-10 are provided, which the training person can select, wherein the maximum braking action would be provided at step 10. A reference rundown time is stored in the calibration table for each defined braking setting step, optionally also for step 0. If the actual rundown time is known, and the comparison results in a difference from the reference rundown time, the computing unit thus searches out the reference rundown time to which the actual rundown time lies closest. The assigned actual setting of the braking device is then accepted in the system. Of course, significantly more than 10 steps are also settable, for example, 20 or 25 steps, via which the resolution with respect to the reference rundown times or the assignment of the actual rundown time to a reference rundown time, respectively, can be detected still more precisely.

Alternatively thereto, it is also conceivable to be able to vary the braking action in 1% steps between 100% and 0% braking action. This embodiment offers the maximum resolution of the braking setting in the form of 100 defined settings, which can be selected by the user. For each percentage step, a defined reference rundown time is provided. A very fine and defined correction with respect to the braking device setting can be performed here, according to which the actual rundown time can finally be compared to 100 reference rundown times and therefore a very precise approximation of the actual rundown time to a given reference rundown time can be found as a result of the fine graduation of the reference rundown times. If this many braking device settings are possible, an extremely large number of setting-specific power values thus also exists, which are entered in the matrix. In the case of a graduation of the braking settings into 100 steps and a subdivision of the speed values with respect to the pedal crank mechanism into 10-RPM steps beginning from 30 RPM up to 130 RPM, a matrix of 100×11=1100 power values therefore results. It is obvious that in this way extremely precise power ascertainment can be performed. If the speed is graduated into 5-RPM steps, for example, the detected power values are thus nearly doubled, still finer graduation is possible. In the case of a graduation into 1-RPM steps, a matrix having 100×110=11,000 power values would result, which permits ultrahigh-precision power ascertainment as a result of the finely-graduated speed division, in particular since as a result of the high-precision detection of the flywheel speed provided according to the invention and, resulting therefrom, the pedal crank speed, it can also be detected very exactly how long the training person has ridden at the respective pedaling speed, so that the respective power fractions can be detected exactly with respect to time and integrated over the training time with respect to speed.

The measuring device or the computing device is expediently implemented to ascertain an average actual rundown time on the basis of two separate actual rundown times, which are ascertained in successively carried out procedures, at identical target setting of the braking device, and is implemented to ascertain the actual setting on the basis of the average actual rundown time. In the scope of the calibration, according to this embodiment of the invention, an actual rundown time is ascertained at least twice at identical target setting of the braking device, an average actual rundown time is determined on the basis of both actual rundown times. The training person must therefore drive the flywheel at the first speed twice, after which the actual rundown time is ascertained twice without further pedaling. This is used for precision, since two defined actual rundown times are provided, which are taken into consideration in the scope of the averaging. Of course, it would also be conceivable to carry out this procedure a third time, so that three actual rundown times are taken into consideration for the averaging. Preferably, at a first setting of the braking device, the actual rundown time is ascertained twice, and subsequently, at a changed second setting of the braking device, the specific actual rundown time is again ascertained twice. I.e., the calibration is performed with respect to two different braking device settings.

On the one hand, the ascertainment of the speed, to detect the achievement of the first and second speeds precisely, and also of course in particular the ascertainment of the rundown time, are essential for the training bicycle according to the invention. To allow this in a simple manner, according to the invention, an element, in particular a magnetic element, which moves past the stationary measuring device during flywheel rotation and in the process is detectable in a contactless manner by the measuring device, is provided according to the invention on the flywheel, wherein the measuring device or the computing device is implemented to ascertain the speed and therefore the first speed and the second speed. In addition, in the same unit, supported on the speed detection, the measurement of the actual rundown time can also be performed, which begins with reaching the first speed and ends with reaching the second speed, for which a corresponding timer or the like is provided in the measuring device or the computing device, which is triggered via the detected first and second speeds. The measuring device or the computing device, to which the corresponding detection signals are provided in this case on the part of the measuring device, thus preferably detects both speed and also rundown time. If the detection is performed on the part of the measuring device, the actual rundown time is relayed to the computing device for further processing in the scope of the comparison. In the scope of the calibration, only the actual rundown time must finally be provided to the computing device, since the actual rundown time is indeed the rundown time between two defined speeds, specifically the first speed and the second speed. In the scope of the calibration, the actual rundown time is also exclusively relevant as stated, it is the decisive single parameter via which the calibration is performed. The computing device now processes the actual rundown time in the provided manner, wherein this is performed on the part of the computing device, of course, if averaging of two or more actual rundown times is to be performed. In the scope of normal training operation, i.e., when no calibration is necessary, of course, the measuring device communicates the continuously ascertained speed to the computing device, which then ascertains and outputs the power values on the basis of the provided speed, to which the stored power values are related (i.e., for example, the crank speed) in conjunction with the braking device setting. As a result of the provided transmission between pedal crank and flywheel, very high flywheel speeds from several hundred RPM to well above 1000 RPM are provided. Extremely short time intervals between two successively detected element passages, which indicate one revolution, result therefrom, which are in the range of several tens of milliseconds to 100 milliseconds, and these time intervals are detected to ascertain the actual speed of the flywheel, therefore small speed changes can also be directly detected, since every speed change is imaged directly in a change of the time interval. This allows a high-precision speed detection and therefore a high-precision detection of the actual rundown time as the foundation for the calibration according to the invention.

As described, a magnetic element can be provided as the element arranged on the flywheel side. A Hall sensor or a Reed sensor, for example, can then be used as a sensor. Alternatively, for example, optical detection is also conceivable. A reflecting element would then be arranged on the flywheel as the element, for example, a reflected light sensor, i.e., an optical sensor would then be provided as a sensor, the device would thus be conceived like a light barrier. Fundamentally, any measuring device which allows the contactless detection of the flywheel rotation and the ascertainment of the very short time intervals is usable.

Expediently, a corresponding calibration mode is selectable on the part of the computing device, in which calibration mode the computing device can be output, via the display device, handling instructions to the user to drive the flywheel to at least the first speed and to end the further actuation of the pedal crank mechanism. The user thus himself has the possibility of selecting this calibration mode, wherein if the user does not himself select the mode within specific time intervals, of course, the computing device also requests the calibration within defined time intervals, i.e., can act independently and prompt the user thereto. The user receives corresponding handling instructions via the computing device, i.e., the calibration is carried out quasi-guided, in that it is concretely communicated to the user what he is to perform.

In addition to the stationary training bicycle itself, the invention also relates to a method for calibrating the power display, which can be ascertained by means of a computing device, of a stationary training bicycle, wherein a calibration table is stored in the computing device, containing a plurality of defined braking device settings, to which reference rundown times of the flywheel, which is not loaded via the pedal crank mechanism, relating to the speed reduction from a defined first speed to a defined second speed are assigned, in which method the user, at a provided target setting of the braking device set by the user, at least once drives the flywheel via the pedal crank mechanism of the training bicycle with continuous speed ascertainment to a speed which at least corresponds to the first speed, after which the actuation of the pedal crank mechanism is ended and, by means of a measuring device or the computing device, the actual rundown time, which the flywheel requires for a drop from the first speed to the second speed, is measured, after which, on the basis of the measured actual rundown time, by comparison to the reference rundown times, the actual setting of the braking device is ascertained and, if actual setting and target setting do not correspond, information relating to the actual setting can be output on the display device. The method according to the invention therefore provides the use of an above-described training bicycle having a corresponding calibration table. In the scope of the method according to the invention, the training person must drive the flywheel at least to the first speed, he subsequently ends the further pedaling. The measuring device now ascertains the actual rundown time for the speed drop from the first speed to the second speed. The computing device, to which the actual rundown time is communicated, now compares the actual rundown time to the reference rundown times stored in the calibration table and thus ascertains the actual setting of the braking device. If the actual rundown time corresponds to a reference rundown time or nearly corresponds thereto, it remains at the displayed braking device setting, i.e., the target setting set by the user finally corresponds to the real actual setting. In the case of non-correspondence, i.e., if the actual rundown time is closer to another reference rundown time than that which is stored for the corresponding braking device setting selected on the user side, the display is changed accordingly and the actual setting is displayed. I.e., the display is changed to the true braking setting. This true braking setting is then accepted into the further ascertainment of the power values or the power values assigned to this actual braking setting are taken into consideration in the integration for determining the power in the scope of the later training, respectively. As a result of the calibration, in the later training, the target settings then selected by the user correctly correspond to the real settings, of course, so that the correct power values are taken into consideration. Power values, which the training person must apply at a given braking device setting and a given speed to drive the flywheel, are incorporated in the calibration table for defined speed values and defined braking device settings, or assigned to the calibration table, wherein the computing device automatically ascertains the power as a function of the given braking device setting and speed on the basis of the stored power values.

The speed of the flywheel is expediently brought to a value greater than the first speed, after which the actuation of the pedal crank mechanism is ended and, with continuous speed detection, the time measurement begins with reaching the first speed. This first speed is to be at least 100 RPM with respect to the actual pedal crank speed, the difference from the second speed is to be at least 30 RPM, preferably at least 50 RPM pedal crank speed. The training person is prompted to pedal, for example, wherein he only receives the instruction to end the pedaling when he is provided with a pedal crank speed of 110 RPM, for example, which can be ascertained from the flywheel speed and the transmission. The speed is continuously detected via the measuring device. The flywheel speed and therefore the theoretical pedal crank speed decrease as a result of the lack of power introduction. Upon reaching the first speed of 100 RPM, the time measurement begins, it ends with reaching the second speed of 50 RPM, for example. The actual rundown time is therefore determined, it is provided to the computing device or inherently detected directly in the computing device, which then receives the corresponding measuring signals from the measuring device with respect to the detection of the element on the flywheel side, wherein the computing device then continues the calibration.

In a refinement of the invention, it is provided that a measuring device is used to detect the speed of the flywheel, comprising an element, in particular a magnetic element, arranged on the flywheel, and a stationary measuring element, which detects the measuring element thereby moving past it once during every revolution of the flywheel and generates a signal indicating this, wherein the time between two successively provided signals is detected for the speed ascertainment, wherein the ascertained time or the speed ascertained therefrom is the parameter which initiates and ends the measurement of the actual rundown time. The speed detection is accordingly based on a high-resolution time detection, in that the time which the flywheel requires for precisely one revolution is ascertained with high precision. For this purpose, a measuring device is used which only comprises an element arranged on the flywheel, for example, a magnetic element, and a stationary measuring device, i.e., a suitable sensor, for example, a Hall sensor. The sensor generates a signal each time the element rotates past it. Since only one element, i.e., for example, only one magnetic element is provided, the time which passes between two successive signals is consequently exactly the time which the flywheel has required for this one revolution (for example, if two elements are provided offset by precisely 180° on the flywheel, a time interval between two signals would thus correspond to half of one revolution, from which the speed may readily be in turn calculated). This measured time is synonymous with the actual speed. Since the signals are generated continuously and therefore the times lying between two signals are detected continuously, the actual speed can therefore be determined very precisely, but therefore also the time speed curve can be determined, and therefore specifically reaching the first speed, at which the measurement of the actual rundown time begins, and also reaching the second speed, at which the measurement of the actual rundown time is stopped. Since, as stated, the pedal crank speed is stepped up, a high flywheel speed is consequently present. Therefore, in the case of higher crank speed, very high flywheel speeds are provided, which are in the range from several hundred RPM to well above 1000 RPM, depending on the concrete transmission. As a result, very short time intervals lie between two successive signals, they are typically in the range of a few milliseconds. This is fundamental for an extremely precise speed detection. This is because as a result of the high-resolution time detection with changes of the time intervals in the millisecond range, minimal resulting speed changes can also be detected. As a result, reaching the first speed and also the second speed can also be detected with ultrahigh precision, from which high-precision ascertainment of the actual rundown time in turn results.

For example, if a transmission ratio of 1:10 is provided, at a crank speed of 70 RPM, for example, a flywheel speed of 700 RPM thus results. For example, the first flywheel speed, at which the measurement of the actual rundown time is to begin, is 600 RPM. At 600 RPM, 100 ms lie between two detection signals generated on the sensor side. As soon as this time interval, or a time interval which is also only minimally greater than 100 ms, for example, 101 ms, is detected, the actual rundown time measurement is initiated, i.e., the measured time interval is used as a trigger. With increasing running down of the flywheel, its speed decreases more and more, as a result the measured time intervals increase more and more. For example, if a speed of 60 RPM is defined as a second speed, at which the measurement of the actual rundown time is ended, this therefore corresponds to a time interval of 1000 ms between two successive sensor signals. As soon as this time interval or a time interval which is also only minimally greater, for example, of 1001 ms, is measured, this indicates that the lower second speed which ends the measurement is reached, and the measurement of the actual rundown time is stopped. At different settings of the braking device, the actual rundown times change automatically, the greater the braking power, the shorter the actual rundown time. Independently of the selected setting, however, the actual rundown time can be detected with high precision in any case, resulting from the high-precision speed detection with high time resolution. The above values are only exemplary, of course, the transmission can be arbitrarily different, from which other speeds result, and also the first and second speeds can be arbitrary. In the training bicycle according to the invention, a measuring device or computing device operating or implemented in this manner, respectively, is consequently provided, which performs the time interval detection and therefore speed detection in the above-described manner and performs the determination of the actual rundown time supported thereon.

The procedure can here be repeated at least once at identical target setting and, on the basis of the two measured actual rundown times, an average actual rundown time can be determined, on the basis of which the determination of the actual setting is performed by comparison to the reference rundown times. I.e., the calibration is supported on two separate actual rundown times. Of course, it would be conceivable to also ascertain three or more such actual rundown times, to have a still broader averaging base.

Alternatively or additionally thereto, the procedure can be repeated at least once at a changed second target setting of the braking device, wherein the determination of the respective actual setting is performed on the basis of each measured actual rundown time or each determined average actual rundown time. Thus, the calibration passage is performed a first time at a first target setting here and any possible new actual setting is displayed. The training person is then prompted to repeat the calibration, wherein beforehand a second target setting is to be selected, which deviates from the first target setting. The actual rundown time ascertained for this second target setting must now correspond nearly exactly to the assigned reference rundown time, if the first calibration was successful. I.e., it can be checked via this second passage whether the first calibration was successful. If this is not the case, and if a rundown time difference is again established in the course of this second calibration procedure, a correction can thus be performed once again. It is conceivable to repeat this procedure a third time, if a correction is once again performed in the second passage, to ensure that the calibration was now correct.

The first actual setting can here be the setting at which no braking action is provided, and the second actual setting can be the setting at which the maximum braking action is provided. Only the influence of the drivetrain is taken into consideration here at the first actual setting, since the brake is not active. In the second passage, the influence of both the drivetrain and also of the braking device, which is then active, is taken into consideration. This is also used to increase the measuring precision.

Finally, by means of the measuring device, according to the invention, both the speed of the flywheel and, optionally calculated therefrom, the pedal crank speed, and also the actual rundown time can be ascertained, i.e., both parameters can be determined using one measuring device. This presumes that the measuring device itself is provided with a suitable processor, i.e., is designed as an independent computer. Alternatively, the measuring device can also only be designed solely as a sensor device, which delivers the signals specific to the flywheel rotation to the computing device, which then performs all data processing procedures and time ascertainments and comparisons, etc.

Figure 2:
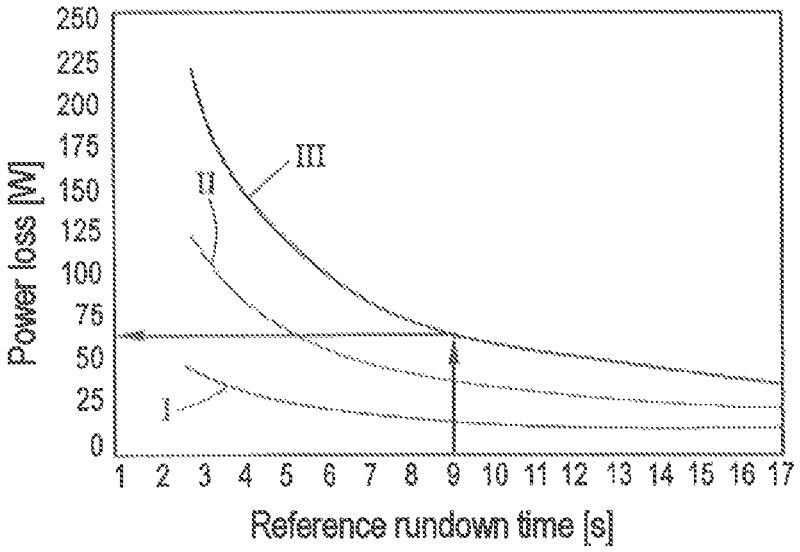
Figures 3, 4:
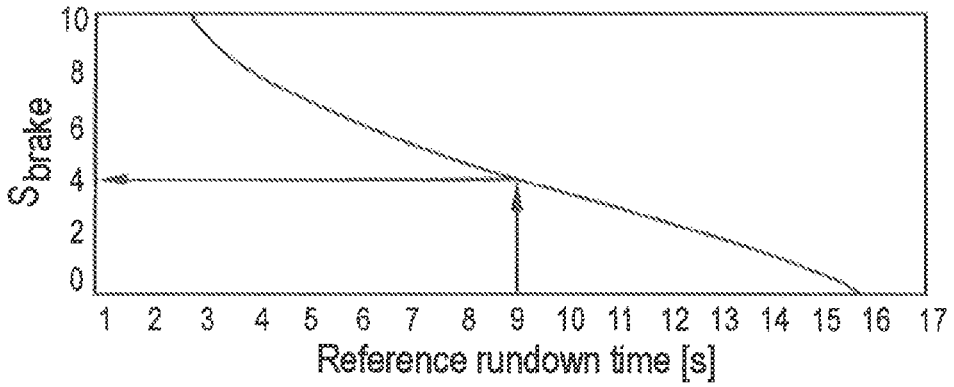

Further advantages, features, and details of the invention result from the exemplary embodiment described hereafter and on the basis of the drawings. In the figures:

FIG. 1 shows a schematic illustration of a training bicycle according to the invention, FIG. 2 shows a graph to illustrate the ratio of power loss to rundown time, FIG. 3 shows a graph to illustrate the ratio of braking device setting to rundown time, and FIG. 4 shows a schematic illustration of a calibration table having assigned power values.

FIG. 1 shows a schematic illustration of a stationary training bicycle according to the invention, wherein only the essential components are shown here. On the one hand, a pedal crank mechanism 2 comprising two pedals 3, which are to be actuated by the training person, is provided. The pedal crank mechanism 2 is coupled via a belt 4 to a flywheel 5. Since the belt pulley 6 provided on the pedal crank mechanism 2 is substantially larger than the belt pulley 7 on the flywheel 5, a transmission is consequently provided. One revolution of the belt pulley 6, therefore thus one complete 360° rotational cycle, results in a plurality of revolutions of the flywheel 7. Depending on the ratio of the diameters of the belt pulleys 6, 7, a defined transmission ratio can be set, for example, a transmission ratio of 1:10. I.e., one rotation of the belt pulley 6 results in ten rotations of the belt pulley 7 and therefore one 360° pedal movement results in 10 rotations of the flywheel 5.

A braking device 8, in the example shown here comprising a magnet 9, is assigned to the flywheel 5, wherein typically two such magnets 9 are provided, which are positioned on both sides of the belt pulley 5 and can be adjusted synchronously in their spacing or coverage ratio, respectively, to the flywheel 5 by radial movement. A permanent magnet is typically used as a magnet. In the example shown, the braking magnet 9 is radially movable relative to the flywheel 5, as shown by the double arrow. In this way, the spacing S of the magnet 9 to the flywheel 5 is variable. The farther away the magnet 9 is positioned from the flywheel 5, the lower its braking action, the closer it is to the flywheel 5 and therefore the smaller S is, the greater the braking action. For example, if two magnets are arranged laterally to the flywheel and are radially displaceable laterally thereto, the lateral overlap thus changes, for example, between 0% (i.e., no overlap) and 100% (i.e., full overlap). The higher the degree of overlap, the greater the eddy current braking effect, and vice versa.

Furthermore, a measuring device 10 is provided, which is used, on the one hand, for detecting the speed of the flywheel 5 and, on the other hand, for detecting the actual rundown time. For this purpose, a magnetic element 11 is provided on the flywheel 5, a corresponding sensor 12, for example, a Hall sensor, is provided on the measuring device 10. Every time the magnetic element 11, which rotates with the flywheel 5, is moved past the sensor 12, the sensor 12 detects a corresponding signal. The measuring device 10 can therefore determine the speed of the flywheel 5 exactly from the time interval of two successively recorded signals, i.e., the duration of a single revolution. The actual time ascertainment and therefore speed ascertainment and also rundown time ascertainment can here either be performed directly on the part of the measuring device close to the flywheel, if it comprises a computing device or processor designed for this purpose. Alternatively, the time ascertainment and therefore speed ascertainment and also rundown time ascertainment can also be performed in the computing device 13 described hereafter, if it has the actual data-processing processor, the computing device 13 would then thus be part of the measuring device for speed and rundown time ascertainment; the measuring device close to the flywheel is only used in this case merely as a sensor, which provides a signal pulse to the computing device upon each passage of the magnetic element and therefore each wheel revolution, the computing device then processing the incoming signal pulses accordingly. Since the flywheel rotates very rapidly at high pedaling speed as a result of the provided transmission from the pedal crank to the flywheel, i.e., at high speed (typically of several hundred RPM up to well above 1000 RPM in some cases), the measuring device and/or the computing device are designed for corresponding high-frequency signal detection or data processing.

Furthermore, as stated, the measuring device 10 can also determine the actual rundown time, i.e., the time which the flywheel 5, which is no longer driven via the pedal crank mechanism 2, requires to drop from a first speed, for example, relating to the pedal crank mechanism, for example, 100 RPM, to a second speed, for example, 50 RPM. Since the measuring device 10 detects the speed with high precision, the actual rundown time can therefore also be detected extremely precisely.

Furthermore, a computing device 13 is provided, to which, on the one hand, the detected speed values and also the detected actual rundown time in the calibration case are provided by the measuring device 10. On the other hand, the setting of the braking device 8 selected by the user, for example, via a display device 14 implemented as a touchscreen, is also known on the computing device side, which setting can be adjusted in accordingly defined steps. For example, the braking device 8 can be moved into ten defined positions, so that therefore ten different spacings S result. However, still a finer resolution is also conceivable, for example, in that the braking device can be set in percentage between 0%-100% braking action, equivalent to 100 defined very finely graduated spacing values S, by inputting the desired percentage value via the display device 14. The mechanical setting is performed via a corresponding, via a suitable drive (not shown in greater detail here) in conjunction with a precise position detection.

In any case, on the one hand, items of information are present on the part of the computing device 13 about the selected target setting of the braking device 8, on the other hand, items of information about the measured actual rundown time, when the calibration is performed, and also the speed in normal operation, are also present.

Furthermore, the display device 14, for example, a color display screen, which is fastened to the handlebars of the training bicycle 1, is assigned to the computing device 13. Corresponding items of information are visualized on this display device 14, inter alia, a power display, and also the provided target braking device setting. The training person can input this, as described, by appropriate actuation of a mechanical actuating element or input of a desired braking setting via the display device 14, for example, a touchscreen, upon which the corresponding position of the braking device 8 or the relative position of the magnet 9 to the flywheel, respectively, is set. The computing device 13 ascertains the power values in normal operation on the basis of the provided speed, detected via the measuring device 10, and, of course, also on the basis of the provided training duration or the time, for which the corresponding speed is ridden, respectively, and, of course, in consideration of the provided target setting of the braking device 8, since this is an essential element of the power to be applied, of course. This is because the braking resistance, i.e., the resistance which opposes the rotation of the flywheel 5 and which is to be overcome by the training person via the pedal crank mechanism 2, is defined via the braking device 8. A variety of power values, which are assigned to the different braking device settings, are stored in the form of a corresponding table in the computing device 13 for this purpose. These power values, which will be discussed in greater detail hereafter, are ascertained, on the one hand, with respect to the defined braking device setting, but also at defined speed steps, for example, with respect to the pedal crank mechanism 2, on the other hand, so that as a result a variety of separate power values are provided, which the computing device 13 detects and integrates over the training time, to ascertain a corresponding power value.

In the scope of the calibration method according to the invention, firstly, on a reference training bicycle, corresponding reference rundown times for the reduction of the flywheel speed or the pedal crank speed (which is in a fixed ratio to the directly detected flywheel speed) from the first speed to the second speed were ascertained at the defined settings of the braking device 8. Furthermore, corresponding power values were ascertained for all braking device settings with respect to defined speeds, for example, on the crank mechanism. These overall values are stored in the form of a calibration or power value table, respectively, in the computing device 13. The reference rundown times are now used in conjunction with the assigned braking device settings in the scope of the calibration. The corresponding values can alternatively also be stored in the form of specifically calculated data algorithms, which define the value curve with respect to a reference value, in the respective table.

The rotation work is introduced via the pedal crank mechanism 2 and also the flywheel 5 into the overall system or the flywheel 5 is accelerated to a specific angular velocity or speed by pedaling the crank mechanism 2, respectively. The change of the rotation work of a physical system having mass inertia is described as follows:

$$\Delta W_{rot} = \frac{J}{2}(\omega_2^2 - \omega_1^2)$$

In this case:

$\Delta W_{rot}$=change of the rotational work

J=mass moment of inertia of the drive system composed of pedal crank mechanism 2 and flywheel 5

ω=angular velocity of the flywheel

After a specific speed or angular velocity $\omega_2$, respectively, has been reached, the introduction of the rotational work is stopped, i.e., pedaling is no longer continued. The overall system found in rotation or in particular the flywheel 5, respectively, now decreases its speed or its angular velocity, respectively, because of friction losses in conjunction with the effect of the braking device 8 to a specific value $\omega_1$, for which a specific rundown time, namely the actual rundown time, is required. This actual rundown time is thus determined as a time difference between the speeds $U_2$ and $U_1$ or, with respect to the above formula, the angular velocities $\omega_2$ and $\omega_1$ by means of the high-resolution measuring device 10.

By way of the physical relationship of the rotational work according to $$W_{rot} = \frac{J\omega^2}{2}$$

with the rotational power, which is ascertained as $$P_{rot} = \frac{W_{rot}}{t}$$

where $P_{rot}$=rotational power t=time, the reference training bicycle can now be completely surveyed and calibrated by means of a reference test stand. The following data are ascertained in this case:

$S_{brake}$=setting of the braking device (position of the brake magnets relative to the flywheel)

Actual rundown time=time difference between first speed and second speed

P=instantaneous power loss in watts with respect to a specific speed of the pedal crank mechanism 2

These values can be entered in a corresponding table, as shown in FIG. 4 and as described in greater detail hereafter. The calibration of mass-produced training bicycles can then be based on this table.

FIGS. 2 and 3 show, in the form of graphs, ascertained on a reference training bicycle, the corresponding relationships between the power loss, which is equivalent to the power which the training person has to apply to drive the flywheel 5 with respect to a specific speed at a specific braking device setting, with respect to the reference rundown time (FIG. 2) and also the ratio of the setting of the braking device with respect to the reference rundown time (FIG. 3).

The reference rundown time in [s] is shown along the abscissa in FIG. 2, and the power loss in [W] is shown along the ordinate. The power is shown for three different speed levels. Curve I shows the power curve over the rundown time at a pedal speed of 40 RPM, curve II shows the curve of the power loss at a pedal speed of 80 RPM, and curve III shows the curve of the power at a pedal speed of 120 RPM, respectively at an identical, unchanged position of the magnets to the flywheel.

It is apparent that the power loss, i.e., the power which is dissipated via the drive and braking system during the rundown, respectively decreases the greater the rundown time is.

FIG. 3 shows the relationship of the reference rundown time, which is again shown along the abscissa in [s], with respect to the braking device setting, which is only shown here in the form of a total of 10 setting steps, wherein step 0 denotes no braking action and step 10 denotes maximum braking action, i.e., the braking magnet 9 is positioned here in the closest possible position to the flywheel 5.

It is apparent that the rundown time increases more and more the more remote the braking magnet 9 is from the flywheel 5, therefore the less the braking action is.

The respective power loss and also the respective braking device setting are specified in FIGS. 2 and 3 in each case for a reference rundown time of 9 s. If the rundown time is 9 s, the braking device is thus located at the setting 4. The power loss, which is assigned here to a revolution of 120 RPM, for example, is approximately 67 watts, for example.

A table which is ascertained with regard to the reference training bicycle and is to be used as a calibration table for subsequent standard training bicycles, as shown in FIGS. 2 and 3, accordingly appears as follows, for example:

| $S_{brake}$ | Reference rundown [s] | P (40 RPM) [W] | P (80 RPM) [W] | P (120 RPM) [W] |
|---|---|---|---|---|
| 0 | 15.62 | 8 | 23 | 41 |
| 1 | 14.36 | 9 | 24.5 | 45 |
| 2 | 12.62 | 10 | 28 | 51 |
| 3 | 10.78 | 11 | 31.5 | 58 |
| 4 | 8.97 | 13 | 36.5 | 67.5 |
| 5 | 7.27 | 16 | 44.5 | 82 |
| 6 | 5.89 | 19 | 54.5 | 99 |
| 7 | 4.73 | 23 | 68.5 | 125 |
| 8 | 3.79 | 29 | 83.5 | 150 |
| 9 | 3.13 | 36 | 101.5 | 178 |
| 10 | 2.66 | 43 | 123.5 | 221 |

The reference rundown time of 9 s emphasized in FIGS. 2 and 3 apparently corresponds to the power loss of 67.5 W specified in the table, wherein 8.97 is specified there as an example as the measured reference rundown time. The braking setting corresponding to the reference rundown time of 9 s is step 4, as results from the calibration table.

Finally, FIG. 4 shows a more extensive table, which comprises, on the one hand, the calibration table comprising the braking device settings with assigned reference rundown times, and in which, on the other hand, supplementary thereto, the power values related to the speed of the pedal crank are entered. While in the above-specified exemplary calibration table, the braking settings are specified in steps 0-10, wherein each step specifies the respective spacing of the braking magnets, for example, and step 10 defines the minimum spacing in millimeters and step 0 defines the maximum spacing in millimeters, in the table shown in FIG. 4, percentage steps in relation to the respective maximum braking action are specified as braking device settings. These braking settings extend in the example shown from 10%-100% in 10% steps in each case. 10% thus means 10% of the maximum braking power, therefore, the braking magnet 9 is thus still relatively far away from the flywheel 5, 100% means maximum braking power, i.e., maximum approach or overlap of the braking magnet 9 to the flywheel 5.

In the next following column, the reference rundown times measured on the reference training bicycle are specified in [s] for each defined braking device setting. The reference rundown times apparently decrease with increasing braking power. The reference rundown time at minimum braking action of 10% is 19.54 s, for example, and that at maximum braking power of 100% is 6.11 s. This curve finally corresponds to the curve shown in FIG. 3.

In the following matrix field, the defined speed steps on the pedal crank in [RPM] are specified as the abscissa, and indeed respectively in steps of 10 beginning with 30 RPM up to 130 RPM. These pedal crank speeds correspond because of the transmission ratio to much higher rotation speeds of the flywheel. If a transmission of 1:10 is implemented, a pedal crank speed of 30 RPM thus corresponds to a flywheel speed of 300 RPM, and a pedal crank speed of 130 RPM corresponds to a flywheel speed of 1300 RPM. Since the flywheel speed is in a fixed ratio to the pedal crank speed, the pedal crank speed can therefore be ascertained precisely from the wheel speed detected via the measuring device 10.

For every speed step, again assigned to each braking device setting, i.e., each percent step, corresponding power values measured on the reference training bicycle are entered, i.e., watt values which the training person must apply when he moves the flywheel at the respective speed in the case of the corresponding braking device setting. In the exemplary embodiment shown, this power value matrix is 10×11 in size, therefore, a total of 110 dedicated power values have thus been ascertained via the corresponding reference power measuring station on the reference training bicycle and entered in the matrix.

If the training person is now to perform a calibration, firstly he selects the calibration mode on the part of the computing device 13 via the display device 14 on the mass-produced training bicycle to be calibrated, if the computing device 13 does not request the performance of the calibration itself as a result of a defined time specification, for example. Firstly, it is displayed to the training person via the computing device 13 on the display device 14 that he is firstly to drive the flywheel 5, and for this purpose a minimum speed of at least 100 RPM, preferably of at least 110 RPM, is to be reached on the pedal crank. The training person now complies with this, he pedals until, for example, the required 110 RPM of pedal crank speed has been reached. The measuring device 10 (or the computing device 13, depending on which one has the corresponding processor) continuously detects the speed of the flywheel 5 and calculates the corresponding pedal crank speed via this, since the transmission ratio between pedal crank mechanism 2 and flywheel 5 is indeed known thereto. Upon reaching the required speed of 110 RPM, it is displayed to the training person via the display device 14 that he should end the pedaling procedure. The flywheel 5 now runs down. It is braked in this case via the braking device 8, wherein the (theoretical) braking efficiency corresponds to the corresponding target braking setting previously selected by the training person. For example, if the training person was prompted to set the braking setting "70%", the braking device 8 would thus decelerate the idly running down flywheel 5 at 70% of the maximum braking power. The measuring device 10 continuously measures the actual speed of the flywheel 5 and, resulting therefrom, the pedal crank speed corresponding thereto. Upon reaching, for example, a pedal crank speed of 100 RPM, the time measurement begins, reaching this speed threshold thus acts as a trigger. As the flywheel 5 continues to run down, its speed and therefore also the corresponding pedal crank speed decrease continuously. The decrease is continuously measured via the measuring device 10. As soon as a second speed, for example, according of a 50 RPM pedal crank speed, is reached, the measurement of the actual rundown time via the measuring device 10 is stopped. The actual rundown time of the mass-produced training bicycle has thus been detected with respect to the previously set braking setting of 70%. In the ideal case, i.e., when the mass-produced training bicycle would correspond to the reference training bicycle, 11.07 s would have to be measured as the actual rundown time.

However, for example, if an actual rundown time of 12.56 s results, a time difference is thus provided. The computing device 13 now checks to what extent the measured actual rundown time of 12.56 can still be assigned to the reference rundown time of 11.07 s provided for the braking setting of 70%, or whether an assignment to another braking setting and therefore another reference time is necessary. Since only 10 reference rundown times are provided in the example shown here, of course, a certain time interval is placed around each reference rundown time, within which an actual rundown time can still be located, to be able to be assigned to the corresponding reference rundown time. Proceeding from the example of an actual rundown time of 12.56 s, the computing device would now recognize that this actual rundown time, which is optionally also rounded somewhat, for example, by one decimal point to 12.6 s, is closer to the reference rundown time of 13.12 s for the braking device setting of "60%" than the reference rundown time of 11.07 s for the set braking device setting of "70%". In this case, a display change is therefore immediately brought about on the part of the computing device 13 via the display device 14, in such a manner that the display of the target braking device setting of "70%" provided up to this point is changed to the actual setting of "60%". This is because a braking action as a result of the real braking setting of only approximately 60% is indeed finally actually applied, but not of the previously provided 70%. The computing device 13 now henceforth corrects the corresponding braking setting display in such a manner that the braking setting, which is now correct because it has been calibrated, is always displayed even in the event of a change of the setting, also if the setting is subsequently changed by the training person.

In a corresponding manner, the corresponding power values assigned to the calibrated braking device setting are henceforth also taken into consideration in the scope of the power ascertainment. Proceeding from the above-described example, in which the training person has previously set 70%, but actually a braking setting of only 60% was provided, if he now continued the training with the correct 60% setting, the power values provided in this line would be used as the basis, depending on which concrete pedal crank speed he rides at in the following training operation.

Of course, the calibration can be performed in both directions. If a time of 10.2 s had resulted in the scope of the calibration as an actual rundown time, for example, the computing device would have thus output the target setting of "80%" on the display device 14, therefore it would have thus ascertained that the real braking action is not 70% as set, but rather is in fact (approximately) 80%.

In the exemplary embodiment shown, only 10 braking settings are specified. Of course, it is possible to graduate the braking settings substantially more finely, for example, in 1% steps, beginning from 1% up to at most 100% braking action. I.e., a total of 100 settings are provided. A corresponding reference rundown time has been ascertained on the reference training bicycle for each braking setting, so that 100 reference rundown times are also provided. If an actual rundown time has now been ascertained, it can thus be assigned substantially more exactly to a 1% step, so that, for example, a shift from a set braking setting of 70% to 64% occurs in the case of an ascertainment of an actual rundown time of 12.56 s, for example. The calibration can thus be performed substantially more precisely, since substantially smaller time intervals are to be placed around the individual reference rundown times of the 100 position steps than in the case of only ten reference rundown times. In a corresponding manner, of course, substantially more power values are also provided, wherein these can be split up not only in steps of 10, of course, but rather also in steps of 5 with respect to the speed, for example.

Of course, it is conceivable to carry out the described procedure not only once, but rather two or three times, for example, therefore thus to ascertain two or three actual rundown times, respectively at the identical braking device setting. The computing device 13 now ascertains from these multiple actual rundown times an average actual rundown time, which is then compared to the reference rundown times. The actual rundown time is thus ascertained here on a broader base.

After a completed calibration, a second test run can be carried out. For example, the user is prompted via the display device 14, instead of the braking device setting corrected to 60%, for example, to change this setting to 40%. The prompt is then again provided of pedaling until a pedal crank speed of 110 RPM, for example, is ascertained, after which the pedaling operation is ended and, upon reaching 100 RPM, the time measurement begins, which ends at 50 RPM, for example. An actual rundown time is thus again ascertained with respect to the braking device setting of 40%. This actual rundown time must now be in the range of the reference rundown time of 16.23 s in the example shown, or in the assigned time interval, respectively. If this is the case, the first calibration was successful.

Although in the above-described example 100 RPM and 50 RPM, respectively, are specified as the first and second speeds with respect to the pedal crank mechanism or the pedals, it would be conceivable, of course, to use the flywheel speeds directly as the basis, which are measured directly via the measuring device 10. At a transmission ratio of 1:10, for example, 1000 RPM would then be used as a first flywheel speed and 500 RPM would be used as a second flywheel speed, i.e., the actual rundown time between these two speed values is measured. Furthermore, the power values can also be assigned to corresponding flywheel speeds in the case of known transmission ratio, i.e., flywheel speeds of 300-1300 RPM in the example. The ascertained results would be the same, of course.

The precise detection of the first speed, which triggers the measurement, and the second speed, which ends the measurement, is decisive for the actual rundown time measurement. This is possible using the training bicycle according to the invention, since a high-resolution detection of the duration of a revolution of the rapidly rotating flywheel 5 is performed. A measuring device is used for this purpose, which only comprises a magnetic element 11 arranged on the flywheel 5 and a stationary measuring device 12, i.e., a suitable sensor, for example, a Hall sensor. The sensor generates a signal each time the magnetic element rotates past it. Since only one magnetic element is provided, the time which passes between two successive signals is consequently exactly the time which the flywheel has required for this one revolution. This measured time is synonymous with the actual speed. Since the signals are generated continuously and therefore the time intervals lying between two signals are therefore continuously detected either on the part of the measuring device itself or on the part of the computing device, which are designed for detecting time intervals in the millisecond range, the actual speed can therefore be determined very precisely. Therefore, however, the time speed curve, and therefore concretely reaching the first speed, at which the measurement of the actual rundown time begins, and also reaching the second speed, at which the measurement of the actual rundown time is stopped, are also detectable with high precision. Since, as noted, the pedal crank speed is stepped up, a high flywheel speed therefore exists. Therefore, at higher crank speed, very high flywheel speeds are provided, which are in the range of several hundred RPM to well over 1000 RPM, depending on the concrete transmission. As a result, very short time intervals lie between two successive signals, in particular at higher speeds they are in the range of several tens of milliseconds to 100 milliseconds (at a speed of 1000 RPM, for example, the time interval is only 60 ms, at a speed of 600 RPM, the time interval is 100 ms). This is fundamental for extremely precise speed detection. This is because, as a result of the high-resolution time detection with changes of the time intervals in the millisecond range, minimal speed changes thus resulting can also be detected. As a result, reaching the first speed and also the second speed can also be detected with ultrahigh precision, from which a high-precision ascertainment of the actual rundown time in turn results.

The invention claimed is:

1. Stationary training bicycle, comprising;

a pedal crank mechanism, which is coupled via a transmission to a flywheel, a magnetic braking device, which interacts with the flywheel and is variable in its braking action, and a computing device having assigned display device, wherein a calibration table is stored in the computing device, containing a plurality of defined braking device settings, to which reference rundown times of the flywheel, which is not loaded via the pedal crank mechanism, relating to the speed reduction from a first speed to a second speed are assigned, wherein for the calibration the actual rundown time of the flywheel at a given target setting of the braking device is ascertained at least once by means of a measuring device or the computing device and, on the basis of the measured actual rundown time, by comparison to the reference rundown times, the actual setting of the braking device specific for the rundown time is determined and, if actual setting and target setting do not correspond, information relating to the actual setting can be output on the display device, and wherein power values that a training person has to apply for defined brake device settings and defined rotational speeds to drive the flywheel are stored in the calibration table and the computing device is configured to automatically determine an instantaneous applied power as a function of a currently selected brake device setting and a current rotational speed based on the stored power values.

2. Training bicycle according to claim 1, wherein the braking action is variable in steps between a maximum braking action and no braking action.

3. Training bicycle according to claim 1, wherein the braking action is variable in 1% steps between 100% and 0% braking action.

4. Training bicycle according to claim 1, wherein the measuring device or the computing device is implemented to ascertain an average actual rundown time on the basis of two separate actual rundown times, which are ascertained in successively carried out procedures, at identical target setting of the braking device, and is implemented to ascertain the actual setting on the basis of the average actual rundown time.

5. Training bicycle according claim 1, wherein a magnetic element, which moves past the stationary measuring device during flywheel rotation and in the process is detectable in a contactless manner by the measuring device, is provided on the flywheel, wherein the measuring device or the computing device is implemented to ascertain the speed and therefore the first speed and the second speed on the basis of the time intervals provided between two successively detected passages of the element.

6. Training bicycle according to claim 5, wherein the measuring device or the computing device also to ascertain the actual rundown time between reaching the first speed and reaching the second speed.

7. Training bicycle according to claim 1, wherein a calibration mode is selectable on the part of the computing device, in which calibration mode the computing device can be output, via the display device, handling instructions to the user to drive the flywheel to at least the first speed and to end the further actuation of the pedal crank mechanism.

8. Method for calibrating the power display, which can be ascertained by means of a computing device, of a stationary training bicycle, wherein a calibration table is stored in the computing device, containing a plurality of defined braking device settings, t which reference rundown times of the flywheel, which is not loaded via the pedal crank mechanism, relating to the speed reduction from a defined first speed to a defined second speed are assigned, in which method a user, at a provided target setting of the braking device, at least once drives the flywheel via the pedal crank mechanism of the training bicycle with continuous speed ascertainment to a speed which at least corresponds to the first speed, after which the actuation of the pedal crank mechanism is ended and, by means of a measuring device or the computing device, the actual rundown time, which the flywheel requires for a drop from the first speed to the second speed, is measured, after which, on the basis of the measured actual rundown time, by comparison to the reference rundown times, the actual setting of the braking device is ascertained and, if actual setting and target setting do not correspond, information relating to the actual setting can be output on the display device, wherein power values that the user has to apply for defined brake device settings and defined rotational speeds to drive the flywheel are stored in the calibration table and the computing device is configured to automatically determine an instantaneous applied power as a function of a currents selected brake device setting a current rotational speed based on the stored power values.

9. Method according to claim 8, wherein the speed of the flywheel is brought to a value greater than the first speed, after which the actuation of the pedal crank mechanism is ended and, with continuous speed detection, the time measurement begins with reaching the first speed.

10. Method according to claim 8, wherein a measuring device is used to detect the speed of the flywheel, comprising an element, in particular a magnetic element, arranged on the flywheel, and a stationary measuring element, which detects the measuring element thereby moving past it once during each revolution of the flywheel and generates a signal indicating this, wherein the time between two successively provided signals is detected for the speed ascertainment, wherein the ascertained time or the speed ascertained therefrom is the parameter which initiates and ends the measurement of the actual rundown time.

11. Method according to claim 10, wherein the ascertainment of the speeds and the actual rundown time is performed on the part of the measuring device or on the part of the computing device.

12. Method according to claim 8, wherein the first speed is with respect to a pedal crank speed of at least 100 RPM and the difference to the second speed with respect to the pedal crank speed is at least 30 RPM.

13. Method according to claim 8, wherein the procedure is repeated at least once at identical actual setting and, on the basis of the two measured actual rundown times, an average actual rundown time is determined, on the basis of which the determination of the target setting is performed.

14. Method according to claim 8, wherein the procedure is repeated at least once at a changed second target setting of the braking device, wherein the determination of the respective actual setting is performed on the basis of each measured actual rundown time or each determined average actual rundown time.

15. Method according to claim 14, wherein the first actual setting is the setting at which no braking action is provided, and the second actual setting is the setting at which the maximum braking action is provided.

* * * * *